United States Patent [19]

Meadus et al.

[11] 4,057,486

[45] Nov. 8, 1977

[54] SEPARATING ORGANIC MATERIAL FROM TAR SANDS OR OIL SHALE

[75] Inventors: F. Weldon Meadus; Bryan D. Sparks; Ira E. Puddington; J. Redmond Farnand, all of Ottawa, Canada

[73] Assignee: Canadian Patents and Development Limited, Ottawa, Canada

[21] Appl. No.: 595,762

[22] Filed: July 14, 1975

[51] Int. Cl.[2] ..... C10G 1/04

[52] U.S. Cl. ..... 208/11 LE; 210/21; 210/21

[58] Field of Search ..... 208/11 LE

[56] References Cited

U.S. PATENT DOCUMENTS

| | | | |
|---|---|---|---|
| 3,459,653 | 8/1969 | Benson | 208/11 LE |
| 3,542,666 | 11/1970 | Simpson | 208/11 LE |
| 3,553,098 | 1/1971 | Claridge et al. | 208/11 LE |
| 3,553,099 | 1/1971 | Savage et al. | 208/11 LE |
| 3,875,046 | 4/1975 | Rosenbloom | 208/11 LE |
| 3,984,287 | 10/1976 | Meadus et al. | 208/11 LE |

*Primary Examiner*—Delbert E. Gantz
*Assistant Examiner*—James W. Hellwege
*Attorney, Agent, or Firm*—Alan A. Thomson

[57] ABSTRACT

Tar sands and like mineral solids-plus petroleum deposits are separated into a petroleum fraction and a solids fraction by contacting with an organic solvent or diluent (in one or more stages) to give a liquid slurry, providing in the system a small amount of an aqueous agglomerating liquid, mixing and agitating until discrete compact agglomerates of hydrophilic solids form, separating the solid easily-handled agglomerates and recovering the petroleum fraction and solvent or diluent. This process avoids the large volumes of aqueous effluent inherent in the "hot water" and other processes using large amounts of water. The solid agglomerates may be used as clean fill, sintered to aggregate, or modified to serve as soil amendments.

18 Claims, No Drawings

SEPARATING ORGANIC MATERIAL FROM TAR SANDS OR OIL SHALE

FIELD OF THE INVENTION

This invention is directed to the separation of mineral solids from hydrocarbons, particularly bitumens of kerogens, the mixtures thereof usually occurring naturally as tar sands, oil sands, oil shales etc. The mineral solids are finely divided, or are rendered so by pulverizing, grinding etc. The mineral solids are caused to agglomerate into discrete, compact units (substantially free of the hydrocarbon) which are readily separated mechanically, Particular reference will be made to the Athabasca tar sands in Alberta but the invention is applicable to other such deposits.

DESCRIPTION OF THE PRIOR ART

Currently the hot water method (Clark) of separating the Athabasca tar sands is leaving large volumes of tailings containing sand, clay and water, which are becoming a serious disposal problem. Large dikes are being used to contain this effluent in extensive disposal ponds. The finely divided clay etc. tends to form a stable suspension in the water, and flocculation or other clay removal step is considered uneconomic for the large volumes involved. The current hot water process will operate favourably with only up to about 6% clay in the feed but much of the tar sands is higher in clay and an average of 10% clay is considered realistic. Thus the clay content is leading to a major liquid effluent disposal problem. Also froth control and emulsification are difficult to handle in the hot water process.

Instead of an initial hot water treatment, proposals have been made to treat the tar sands with a solvent or diluent for the bitumen, and then float or otherwise separate the organic phase in an aqueous medium which retains the sand and clay materials. This process also requires large amounts of water and would present the same type of disposal problem. It has also been proposed to filter a tar sands-filuent system to which small amounts of water have been added. However, filtration in this context has many drawbacks, in particular the large volumes involved and the blinding of the filter media with fine solids.

It would be desirable to recover the hydrocarbon without using significant amounts of water and to have the tailings as easily handled solids using a simpler operation than filtration.

SUMMARY OF THE INVENTION

We have found that compact agglomerates of the siliceous solids can be formed in situ and that these agglomerates are easily separated e.g. by decanting, screening etc. These compact agglomerates are easily handled and can be disposed of as clean fill, or converted to useful aggregate by firing, use of adhesive cement or the like. There is no aqueous liquid effluent to present a disposal problem.

In accordance with the invention, a solvent or diluent is used to disperse the hydrocarbon or bitumen, a critical amount of water is added, and the liquid system agitated until agglomerates of the sand (hydrophilic solids) have formed and built up to an easily separated and handled size. Our method of separating siliceous solids usually including clay from hydrocarbons or bitumens of deposits or mixtures thereof, the solids being in finely divided form, comprises:

a. distributing an organic solvent or diluent for the hydrocarbons into the mixture in sufficient amounts to dissolve or disperse the hydrocarbons and provide a liquid slurry, b. providing an aqueous agglomerating liquid in the diluted mixture in total amounts of from about 8 to about 50% by wt. of the feed mixture, c. agitating the multi-phase mixture severely enough and for a sufficient time to contact intimately the aqueous liquid and the siliceous solids, continuing agitation until the aqueous liquid and the hydrophilic siliceous solids form into discrete, compact agglomerates, d. separating the compact agglomerates from the organic phase, and e. recovering said hydrocarbons and solvent or diluent.

DETAILED DESCRIPTION AND PREFERRED EMBODIMENTS

The particle size of the solids in the feed will normally be the naturally-occurring size distribution. Lumps containing solids and bitumen should be broken up before or after the addition of the solvent or diluent. In some cases some form of comminution of lumps or solids may be necessary. Usually the particle size is well below 1 mm. diameter and significant amounts of very fine clay (up to about 25% or more of the feed) are present.

The organic solvent or diluent is a low viscosity hydrophobic organic liquid which will at least disperse and preferably will dissolve the hydrocarbon or bitumen to form a readily flowing slurry. Suitable solvents or diluents include aliphatic hydrocarbon solvents, kerosene, distillate from a fractionation unit e.g. naphtha and like fractions, aromatic solvents, halogenated hydrocarbon solvents, liquefied petroleum fractions etc., and mixtures thereof. Usually within about 20 to about 100% by wt. of the feed, of the solvent or diluent will be suitable, but this is not critical and will depend on the nature of the feed mixture and of the solvent or diluent. The wt. ratio of solvent to bitumen (or kerogen) will usually be at least about 2:1, to obtain a workable slurry vicosity.

The aqueous agglomerating liquid is selected to be substantially insoluble in the organic solvent or diluent and to have an affinity for the siliceous mineral solids in the feed. With tar sands, the pH is suitably about 6–10. An alkaline pH has been found beneficial, preferably about pH 7.5 to 9.5 The pH is suitably adjusted with alkali metal hydroxide or silicate. Waste aqueous effluents, desirably of alkaline pH, may be operative. The amount of agglomerating liquid is important and should be sufficient to wet substantially all of the hydrophilic solids, but insufficient to form large soft agglomerates thereof. The total amount of aqueous liquid required will be within about 8 to about 50% by wt. of the feed mixture. Part of this total will derive from moisture in the feed material. The optimum amount within this range will depend largely on the particle size and size distribution of the solids, (the increased surface area of finer particles requiring slightly more aqueous liquid), and on the size and compaction of the agglomerates desired. If too little water is present the agglomeration is incomplete and the agglomerates too small for ready separation.

The multi-phase mixture (organic, solids, aqueous) is well mixed and agitated to contact intimately the aqueous liquid with the individual particles, the aqueous liquid gradually displacing any retained bitumen phase from the siliceous surface. Agitation severe enough to bump repeatedly the solid particles together is required, and this should be continued until the aqueous liquid and hydrophilic siliceous solids build up into discrete compact agglomerates. The agglomerate size will gradually increase with agitation time until a stable uniform size is reached. It has been found desirable to alter the agitation required for initial blending to that including a rolling or tumbling motion for at least the final stages of the agglomeration. It is believed the main limiting factor is when substantially all of the aqueous liquid is in the interior of the agglomerate and the agglomerates themselves are too rigid to coalesce. If excess water was present this condition would not hold and pasty or soft "wet" agglomerates would continue to coalesce and grow and would never become rigid, compact and free-flowing (which is highly desirable for effecting a clean separation and easy handling). Soft or pasty agglomerates, besides being difficult to separate and handle, tend to occlude more organic phase and recoveries are poor.

The discrete compact agglomerates readily settle and decanting will remove the bulk of the organic phase. Screening is also very effective for removing the agglomerates. Surface organic phase can be washed from the agglomerates with solvent or diluent, with the washed agglomerates normally containing less than about 3% organic material. Residual organic remaining with the agglomerates can be recovered by distillation or by extraction e.g. with liquid petroleum gases e.g. butane with the resulting liquid being allowed to flash off (the loaded LPG being processed and recycled), or burned for heat. The agglomerates would be suitable for fluidization e.g. moving bed or spouted bed such as in a fluidized bed conversion unit. The fired agglomerates also make a useful aggregate for concrete, roadbeds etc. If a soluble flux such as NaCl, KCl, $CaCl_2$ and other halide salts, is added to the aqueous liquid, and the agglomerates sintered at elevated temperatures, very strong aggregate is produced.

The organic phase is readily pumped to a distillation or other fractionating or conversion unit. Usually an initial distillation is carried out to recover a low boiling liquid fraction for recycle to the process. If the organic phase can carry more bitumen, it can be recycled to contact feed mixture without further processing.

A continuous operation is desirable to handle the large volumes involved. While numerous agitation devices that operate continuously e.g. centrifugal pumps, blenders and the like, are readily available, a very suitable novel apparatus for this purpose had been developed (see U.S. Pat. No. 3,984,287, Oct. 5, 1976, F. W. Meadus et al). An outline of the process steps for one such continuous operation is as follows. In a primary stage tar sands feed, solvent or diluent, and aqueous agglomerating liquid are mixed and an underflow of this mixture is fed over a sloped screen with solvent containing extracted tar being recovered under the screen. Recycle of part of this organic extract is usually made to the primary stage, with the remainder being processed as product. The mixture retained on the screen is fed into a second stage mixer-agglomerator (which very suitably is a rotating conical vessel). Additional trimming aqueous agglomerating liquid and solvent or diluent are fed to the mixture and mixing and agitation continued. Loaded organic phase and solid agglomerates are continuously removed from this second stage. Desirably there is a counter-current flow of liquid and solids in this second stage. This latter organic phase is preferably used to contact fresh tar sands feed. The continuously withdrawn agglomerates may be washed, suitably with fresh solvent or diluent to remove as much residual bitumen as possible. This wash solvent may then be used as make-up organic for the second (agglomeration) stage.

The following Examples illustrate the invention. All parts are by wt.

EXAMPLE 1

A sample of tar sands from Great Canadian Oil Sands (with 25% being fines of −325 mesh) was mixed with kerosene and water in the following proportions:

tar sands: 30 parts (7.65 $H_2O$)
kerosene: 49 parts
water: 2 parts containing NaOH to pH 9.5

This mixture was shaken in a closed partially-filled container for 30 minutes. After this agitation, balls of the sand and clay had formed ranging in diameter from about 1.5 to 12 mm. These balls were compact, easily separated and appeared free of bitumen.

EXAMPLE 2

Tar sand, kerosene and water were mixed in a stirred blender in the following proportions:

tar sand: 120 parts (7.6% $H_2O$)
kerosene: 200 parts
water: 5 parts, NaOH to pH 9.5

The bitumen largely dissolved and initial small agglomerates formed. This mixture was then transferred to a rotating drum and subjected to controlled agitation for 15 minutes. The tumbling action in the drum could be controlled to produce round, compact balls with a narrow size distribution. Uniform larger agglomerates of about 2 mm. diameter were removed from the drum and washed with kerosene. The petroleum fraction was virtually free of water and solids, while the agglomerates contained 3.6% organic material and 11.7% water.

EXAMPLE 3

A blender was used to mix the following:

tar sands: 200 parts (7.6% $H_2O$)
Aliphatic hydrocarbon solvent: 200 parts (Varsol-Trademark)
water: 8 parts This mixture was transferred to a rotating drum where it was less violently agitated for 15 minutes to form larger round compact agglomerates of about 2 mm. diameter. The agglomerates were washed with 140 parts of kerosene and the combined organic phase recycled to contact tar sand feed. After four cycles no change in results was observed, indicating that at this solvent to tar sands ratio extensive recycling of solvent is desirable.

EXAMPLE 4

A sample of tar sand has been exposed to air for an extended period and the tar content was more oxidized and more viscous than usual. Halogenated hydrocarbon or aromatic hydrocarbon solvents were added to aid dispersing the very viscous tar. The following ingredients and proprotions were used:

Oxidized tar sand: 1 part (<1% $H_2O$)
Aliphatic hydrocarbon solvent: 4.8 parts
carbon tetrachloride: 4.8 parts
dilute aqueous sodium:
silicate solution: 0.6 part The first three components were agitated with a reciprocating motion to dissolve the tar portion. The alkaline silicate solution added and agitation continued for 15 minutes. Uniform balls of sand-clay about 1 mm. diameter formed and were easily separated on a 20 mesh screen.

About 8 parts of benzene was used as solvent in a further test with similar results. The silicate solution was replaced with about 0.3 parts of 50/50 glycerine/-water and larger sand-clay balls of about 4 mm. diameter were formed.

EXAMPLE 5

Ten parts of freshly mined tar sand containing 11% oil, 3% $H_2O$ and about 25% clay were dispersed in 30 parts of Varsol with agitation. Then 3.6 parts of 0.05 N NaOH was added and milder agitation continued for about 5 minutes. Clay-sand balls of about 1–5 mm. diameter formed and were readily separated and handled.

Recoveries of hydrocarbon were at least about 90% for all the above examples.

EXAMPLE 6

Further work has been conducted on the continuous agglomeration of high clay tar sands. A series of experiments was carried out using the procedure outlined above. High clay tar sands (23% −325 mesh) were mixed in the primary extractor with Varsol and appropriate amounts of added water.

| Typical Feed for Primary Extractor | | |
|---|---|---|
| Tar Sands | 340 parts | (3.8% $H_2O$) |
| Overflow Varsol | 400 parts | |
| Water | 15 parts | (pH 9.5 with NaOH) |

After mixing (for 1–2 minutes), the water-conditioned sand and solvent were drained on a screen. The solvent, which now contained most of the bitumen, was then either returned to the primary extractor for further contacting additional tar sand, or stripped of the bitumen by distillation. Desirably the solvent is allowed to settle to lower the solids and water content before further processing. The drained sands were fed to a rotating cone agglomerator where additional "trimming" water was added. The rotating action in the cone agglomerator causes very spherical balls to form. The balls contain only a small amount of organic liquid and most of the water. On emerging from the agglomerator, the balls were washed with clean Varsol, to remove surface bitumen, and then drained. A counter-current flow of solvent (Varsol) was maintained through the apparatus; first, as the clean wash, then as the secondary extractant in the cone agglomerator, and finally as the primary extractant.

The process was operated continuously, and the following results obtained (Table I). Recovery of the bitumen was about 94%.

TABLE I

CONTINUOUS AGGLOMERATION OF TAR SANDS

| | | Weight parts/hr. | Sand % | Water % | Bitumen % | Varsol % |
|---|---|---|---|---|---|---|
| IN | | | | | | |
| | Tar Sands Feed | 8.0 | 88.4 | 3.75 | 7.8 | — |
| | Primary Water | 0.35 | — | 100 | — | — |
| | Trimming Water | 0.15 | — | 100 | — | — |
| | Varsol Wash | 6.5 | — | — | — | 100 |
| | TOTAL WEIGHTS parts/hr. | 15.0 | 7.1 | 0.8 | 0.62 | 6.5 |
| OUT | | | | | | |
| | Agglomerated Sands | 7.9 | 87.1 | 8.8 | 0.5 | 3.6 |
| | Extracted Solvent | 7.1 | 2.5 | 1.1 | 8.2 | 88.2 |
| | Extracted Solvent-settled | — | 0.1 | 0.5 | 8.3 | 91.1 |
| | TOTAL WEIGHTS parts/hr. | 15.0 | 7.1 | 0.8 | 0.62 | 6.5 |

These rates can be changed; for example, the rate of tar sand feed has been increased to give more than 15% bitumen in the extracted solvent. This feed rate could be increased still further.

The drained agglomerated balls may be heated to remove residual organic liquid which usually amounts to about 2.5–3.5%. Preferably, the extracting solvent or diluent, or wash liquid should not only be a good solvent for the bitumen fraction, but should also form a favourable azeotrope with water (i.e. minimum water content) so that the least amount of heat is required for its recovery. Solvent components for this purpose can be chosen from benzene, trichloroethylene, methylene chloride, chloroform, carbon tetrachloride, toluene, kerosene, methyl ethyl ketone, low boiling aliphatic hydrocarbon, etc.

The drained agglomerates may instead be extracted (to remove residual organic) with a low boiling solvent, particularly with a liquefied petroleum gas e.g. butane which will flash off at ambient temperatures. Such an extraction would be carried out under pressure and the pressure released to volatilize the organic phase.

If the agglomeration is carried out in pentane, then the solvent can be stripped at 34°–36° C and the distillate will contain only 1% water. For example, the composition of such agglomerates dried at 34°–36° C to remove pentane contained only 0.2% total organics, 9.4% water and 90.4% sand and clay.

After heating or releasing pressure to remove solvent or wash liquid, the balls were strong and easily disposed of. If about 1–2% salt was added to the agglomerating liquid as a flux, and if the balls were sintered at a high temperature, very strong balls, suitable as a gravel or aggregate, were produced. The effect of salt on the strength of agglomerates for a high clay and a low clay feed was measured. The sintering was done in air at 1170° C. The strongest balls of higher clay content approached the strength of concrete (400 lbs/inch diameter ball crushing strength).

EXAMPLE 7

Instead of adding water to agglomerate the clay-sand fractions, water containing water-soluble adhesives and emulsion-type adhesives can also be used to form the agglomerates. These adhesives on drying form stronger balls and impart water resistance to the agglomerates. Balls of this type might have special uses, e.g. top soil for use in the back-filled areas with the adhesives enabling the agglomerates to serve as soil conditioners and as anti-erosion aids.

To 100 parts of tar sand dispersed in Varsol, was added 3 parts of 30% aqueous solution of urea-formaldehyde adhesive. On continued agitation, balls formed about ⅜ inches in diameter. The balls were separated on a 20 mesh screen and allowed to dry at room temperature. After drying, the balls were quite tough, and remained intact after 2 weeks immersion in water at 70° F.

This procedure was repeated with the following materials: polyvinyl acetate emulsion; polyacrylic acid emulsion; polyvinyl pyrrolidone solution; and sodium silicate solution. Strong water-resistant balls were obtained in each case.

The siliceous component of the extracted tar sands or oil shales usually occupies about 30% more volume than the original body. In the original state, the oil-coated sand and clay particles probably flow into interstices that would normally remain void in common soil structures, that is, voids occupied with water and/or air only.

As the soil in the geographical area of the Athabasca tar sands is quite poor, a top dressing with this excess fill would probably be desirable and preferably to building hills. If the sand-clay product were used in this manner, water-soluble or -dispersible additives could be used at the agglomeration stage not only for the purpose of soil conditioners and anti-erosion aids, but also as fertilizers and essential trace elements. It appears that most of these individual additives when added to the water used in agglomeration of the sand-clay component have no adverse effects on agglomeration, and some of them, e.g. urea, and urea-formaldehyde, may have beneficial effects, as these compounds are excellent wetting agents for the siliceous materials.

Thesse common urea-type nutrients, the important trace elements, soil conditioners, and anti-erosion aids, may all be added to the soil at the same time in a loaded agglomerate to produce a fertile soil with good tilth.

Experiments were carried out by dissolving or dispersing many different compounds in the agglomerating water, singly and/or collectively, In all cases, the siliceous material could still be balled. Typical examples are given below.

EXAMPLE 8 a. One hundred parts of tar sand were dispersed in 200 parts of Varsol and shaken with a reciprocating motion for 15 minutes. Three parts of a 10% solution of urea were then added and the system shaken for another 15 minutes. Balls about 3 mm. in diameter containing the urea were formed. They were separated from the organic liquid component on a 60 mesh screen.

In a similar manner, the following solutions were all successfully used to agglomerate the siliceous materials: a 10% solution of ammonium nitrate, a 10% solution of ammonium phosphate, a 10% solution of thiourea, a 10% solution of potassium sulfate, a 10% solution of phosphoric acid, a 10% solution of commercial fertilizer extract 7-7-7, a 10% emulsion of nylon, a 10% emulsion of polyvinyl acetate, and a 3% solution of sodium carboxymethyl cellulose. The latter two additives are commercial soil additives.

Experiments were also carried out using solutions of several soil additives collectively, as follows:

b. One hundred parts of tar sand well dispersed in Varsol were agglomerated as before with 3.5 parts of a solution composed of 1% sodium carboxymethyl cellulose, 6% urea-formaldehyde, 4% ammonium phosphate.

c. One hundred parts of tar sand well dispersed in heptane were agglomerated as before with 3.5 parts of a solution composed of 1% sodium carboxymethyl cellulose, 8% of commercial fertilizer 7-7-7 extract, in addition to about 20 p.p.m. approximately of both copper sulfate and zinc nitrate.

The dried agglomerates of (a) – (c) ranged in diameter from about 3 to about 6 mm. and were compact and easily handled. They would make very useful soil amendments.

Benefication of Oil Shale

Oil shale organic material is different from that of tar sands in that the organic is present as kerogen, a high molecular weight solid that is largely insoluble. The shale itself is highly consolidated and must be ground to achieve release of the kerogen. To apply the present process, the finely ground shale is dispersed in a petroleum fraction (suitably a cracked kerogen fraction), and the inorganic mineral particles agglomerated with small amounts of aqueous liquid. The kerogen will not be dissolved like the bitumen but will remain suspended in the organic liquid and must be removed (e.g. by centrifuging, settling or filtering). The agglomerates will be significantly larger than the kerogen particles and will be separated first as by screening or settling.

EXAMPLE 9

One hundred parts of Colorado oil shale containing 16.5% organic matter had previously been ground to −325 mesh in 209 parts of 1.5 N $H_2SO_4$. The ground ore was then filtered to about 25% moisture, dispersed in 160 parts of Varsol, transferred to a polyethylene vessel, and shaken for ten minutes to disperse the solids. Forty parts of 0.1 N $H_2SO_4$ was then added to the mixture for agglomeration and shaking was continued for another 15 minutes. The non-organic portion formed agglomerates about ⅛ to ¼ inch in diameter which were separated, washed and dried at 145° C before being analyzed for organic contet. The concentrate which remained in the Varsol suspension, was filtered, dried and analyzed. A 97% recovery of the organic portion was obtained with a concentrate grade of 62.5% and the tails grade was reduced to 0.45%.

EXAMPLE 10

Example 9 was repeated but water only was used to agglomerate the non-organic portion of the ore. A 94% recovery was obtained with a concentrate grade of 76% and a tails grade of approx. 2%.

Good results were also obtained on this ore when it was ground in the following different acids: hydrochloric, phosphoric, sulfurous, formic and acetic. Also an acid salt of aluminum sulfate was used with similar results.

EXAMPLE 11

When the procedure used in Example 9 was repeated with water containing 5% sodium carboxymethyl cellulose (as a soil conditioner), a 93.1% recovery was obtained with a concentrate grade of 78.8% and a tails grade of 1.9%. Similar results were obtained when agglomeration was carried out with both an 8% solution of polyacrylic acid and an 8% solution of fertilizer extract 7-7-7.

The agglomerates formed with polyacrylic acid and sodium carboxymethyl cellulose were dried overnight at 90° C, and then transferred to a vessel containing water at 60° C. Little disintegration was observed after 4 hours immersion.

EXAMPLE 12

When the procedure in Example 9 was applied to a Nova Scotia shale containing 20.5% organic matter, a 96% recovery was obtained with a concentrate grade of 76.5% and a tails grade of 0.8%.

EXAMPLE 13

One hundred parts of Nova Scotia shale containing 20.5% organic matter was mixed with 160 parts of Varsol and milled for 4 hours. The contents together with 51.5 parts of 1 Normal sulphuric acid were transferred to a polyethylene vessel and shaken for 15 minutes in a 3-dimensional path. Balls about 2 mm. diameter formed which on washing free of acid, were found to contain 8.2% organic matter. The suspension in the Varsol contained about 82% of the total organic matter and had a grade of 41% approximately.

EXAMPLE 14

One hundred parts of Colorado shale was milled with flint balls for 24 hours with 160 parts of heptane and 15 parts of acetic acid. The slurry was then trnsferred to a polyethylene vessel containing about 50 parts of a 10% solution of formamide in water and the system shaken for 15 minutes in an irregular path. The non-organic portion formed balls about ¼ inch in diameter with most of the organic matter remaining in the Varsol suspension. An 89% recovery was obtained with a concentrate grade of 34% and a tails grade of 4% approximately.

Tests of continuous operation in the type of apparatus described by Meadus et al above, have shown that different feed material affected the ease of agglomeration, and the size, strength and controllability of the agglomerates. Coarser sand gave slower agglomeration and weaker agglomerates. For very uniform strong agglomerates, the feed material preferably should contain about 8–15% wt. of the solids (more preferably 10–12%) as fine hydrophilic particles of diameter less than about 0.04 mm. (with a spectrum of larger particle sizes constituting the remainder). Some grades of feed contain less than this amount of very fine material (which is usually clay) and agglomerate formation, strength and uniformity may be unsatisfactory. In this case, higher clay feed material should be blended in, or some clay tailings recycled, where strong dense agglomerates are required.

In continuous operation with varying feed material nucleation of the agglomeration by addition of water droplets or wet recycled solids has been found to accelerate agglomeration and yield more uniform agglomerates (more control of the number and size of the agglomerates can be obtained). The water droplets or nucleating solids are preferably of the order of 2 to 6 mm. diameter. In a continuous operation as the water droplets or nucleating solids are added the mean size of the agglomerates removed decreases and stabilizes, e.g. at about 2 to 3 times the size of the droplets or nucleating solids when the amount of nucleating droplets or solids added is about 1 to 2% by wt. of the feed material. The amounts of nucleating droplets or solids will be taken into account in determining the total aqueous agglomerating liquid percentage based on the feed mixture. An operator could readily determine the amount and size of nucleating additive giving the desired size of agglomerate.

We claim:

1. A method of agglomerating and separating siliceous solids from hydrocarbons of intimate mixtures thereof, the solids being in finely divided form, and further recovering hydrocarbons, the process comprising:

a. distributing an organic solvent or diluent for the hydrocarbon into a feed mixture comprising siliceous solids and hydrocarbons, in sufficient amounts to dissolve or disperse the hydrocarbons and provide a liquid slurry, b. providing an aqueous agglomerating liquid for the siliceous solids in the diluted mixture in total amounts of from about 8 to about 50% by wt. of the feed mixture, the amount being selected within said range to enable agglomerates to form of at least about 2 mm. diameter but insufficient to form large soft agglomerates, said aqueous liquid being substantially insoluble in the solvent or diluent and having an affinity for the siliceous solids, c. agitating the multi-phase diluted mixture severely enough and for a sufficient time to intimately contact the aqueous liquid and the siliceous solids, continuing and controlling the agitation to provide a rolling or tumbling motion until the aqueous liquid and the hydrophilic siliceous solids form into discrete compact agglomerates of at least about 2 mm. diameter, d. separating the compact agglomerates from the organic phase by screening or by density difference, and e. recovering said hydrocarbons and solvent or diluent.

2. The method of claim 1 in which at least part of the solvent or diluent phase from step (a) is separated and recycled to contact fresh feed material, and part is recovered as product.

3. The method of claim 1 wherein part of the organic liquid phase from (d) and all of the solvent or diluent from (e) are recycled.

4. The method of claim 3 wherein an overall countercurrent flow of solvent or diluent versus solids is maintained.

5. The method of claim 1 wherein in step (a) a primary stage extraction by separation of part of the organic phase away from the slurry, followed by addition of further solvent or diluent to the residual slurry, is carried out.

6. The method of claim 1 including a solvent wash of the separated agglomerates from step (d).

7. The method of claim 6 including a final wash of the separated agglomerates with liquefied petroleum gas.

8. The method of claim 1 wherein a distillation step is carried out on the separated agglomerates to remove residual organic material.

9. The method of claim 1 wherein a water-soluble or -dispersible flux is included in the agglomerating liquid and the separated agglomerates are sintered to give strong aggregate.

10. The method of claim 1 wherein water-soluble or -dispersible soil additive components are included in the agglomerating liquid and the resulting additive-loaded agglomerates are useful as soil amendments.

11. The method of claim 1 wherein the solvent or diluent forms a low boiling azeotrope with low boiling content.

12. The method of claim 1 wherein the aqueous agglomerating liquid is added in two or more stages.

13. The method of claim 12 wherein part of the aqueous agglomerating liquid is added as nucleating droplets at the agglomeration stage.

14. The method of claim 1 wherein siliceous solids of selected size are recycled as nucleating solids.

15. The method of claim 1 wherein fine siliceous solids of less than about 0.04 mm. diameter are added to the feed to provide a siliceous solids size distribution more suitable for forming strong dense agglomerates.

16. The method of claim 1 wherein the feed mixture is tar sand deposits.

17. A method of separating oil shale hydrophilic solids from hydrocarbons of intimate mixtures thereof, the solids being in finely divided form, and further recovering hydrocarbons, the process comprising:

a. distributing an organic solvent or diluent for the hydrocarbon into a feed mixture comprising oil shale hydrophilic solids and oil shale hydrocarbons, in sufficient amounts to disperse the hydrocarbons and provide a liquid slurry, b. providing an aqueous agglomerating liquid for the oil shale hydrophilic solids in the diluted mixture in total amounts of from about 8 to about 50% by wt. of the feed mixture, said aqueous liquid being substantially insoluble in the solvent or diluent and having an affinity for the oil shale hydrophilic solids, c. agitating the multi-phase diluted mixture severely enough and for a sufficient time to intimately contact the aqueous liquid and the oil shale hydrophilic solids, containing and controlling the agitation until the aqueous liquid and the oil shale hydrophilic solids form into discrete compact agglomerates, d. separating the compact agglomerates from the organic phase by screening or by density difference, and e. recovering said hydrocarbons and solvent or diluent.

18. The method of claim 17 wherein the feed mixture is acid ground oil shale and at least part of the diluent is a cracked kerogen fraction.

* * * * *